US010191443B2

(12) United States Patent
Iwase

(10) Patent No.: US 10,191,443 B2
(45) Date of Patent: Jan. 29, 2019

(54) IMAGE FORMING APPARATUS

(71) Applicant: CANON KABUSHIKI KAISHA, Tokyo (JP)

(72) Inventor: Masaki Iwase, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/483,113

(22) Filed: Apr. 10, 2017

(65) Prior Publication Data

US 2017/0293253 A1 Oct. 12, 2017

(30) Foreign Application Priority Data

Apr. 12, 2016 (JP) ..... 2016-079419

(51) Int. Cl.

| | |
|---|---|
| ***G03G 15/00*** | (2006.01) |
| ***B41J 29/13*** | (2006.01) |
| ***G03G 21/16*** | (2006.01) |

(52) U.S. Cl.

CPC ..... *G03G 21/1633* (2013.01); *G03G 21/1695* (2013.01); *G03G 2215/00544* (2013.01)

(58) Field of Classification Search

CPC ..... G03G 21/1633; G03G 21/1695
See application file for complete search history.

(56) References Cited

U.S. PATENT DOCUMENTS

| | | | | |
|---|---|---|---|---|
| 8,270,874 | B2 | 9/2012 | Iwase et al. | |
| 9,268,294 | B2 | 2/2016 | Namba | |
| 2004/0145284 | A1* | 7/2004 | Egger | E05F 5/02 312/331 |
| 2016/0159588 | A1* | 6/2016 | Mizuguchi | B65H 31/26 271/147 |

FOREIGN PATENT DOCUMENTS

| | | | |
|---|---|---|---|
| JP | H07-102850 | A | 4/1995 |
| JP | 2006-284805 | A | 10/2006 |
| JP | 2007-279274 | A | 10/2007 |
| JP | 4221628 | B2 * | 2/2009 |
| JP | 2010-014813 | A | 1/2010 |
| JP | 2015-115617 | A | 6/2015 |

* cited by examiner

*Primary Examiner* — David M. Gray
*Assistant Examiner* — Michael A Harrison
(74) *Attorney, Agent, or Firm* — Venable LLP

(57) ABSTRACT

An image forming apparatus includes an openable member rotatable relative to a main assembly of the image forming apparatus; and a supporting member connected between the main assembly of the image forming apparatus and the openable member configured to support the openable member when the openable member is opened. The supporting member includes a first arm member and a second arm member which are slidable relative to each other, a pinion provided on the first arm member, a viscous damper mounted on a rotation shaft of the pinion, a rack provided on the second arm member and engaged with the pinion. By opening the openable member, relative slide movement is caused between the first arm member and the second arm member so that the pinion engaged with the rack rotates and a braking force is produced by the viscous damper.

15 Claims, 7 Drawing Sheets

(a)

(b)

(a)

(b)

IMAGE FORMING APPARATUS

FIELD OF THE INVENTION AND RELATED ART

The present invention relates to an image forming apparatus such as a copying machine, a printer, and the like.

Generally speaking, an image forming apparatus is provided with a jam access door, which is for exposing the recording medium passage of the apparatus to remove a sheet (or sheets) of recording medium such as paper or the like jammed in the recording medium passage while it was conveyed through the passage. From the standpoint of the usability of an image forming apparatus, and also, the efficiency with which a jammed sheet of recording medium can be removed, an image forming apparatus is desired to be structured so that it requires only one jam access door which can expose the entirety of the recording medium passage.

However, in a case where an image forming apparatus is structured so that it requires only a single jam access door to entirely expose the portion of the recording medium passage, which extends from the recording medium feeding portion of the apparatus to the transferring portion of the apparatus, the jam access door has to be substantial in size, being therefore substantial in weight. This creates a problem. That is, if an object is allowed to free-fall, it is accelerated by its own weight. Therefore, there is a concern that if the pivotal downwardly movement of the jam access door, which occurs as the jam access door is unlatched, is not controlled, the jam access door and the main assembly of the image forming apparatus are subjected to a large amount of shock, making it possible for various components in the adjacencies of the recording medium passage to be damaged by the shock, and/or rods or belts with which the jam access door is supported might be damaged by the shock. Further, a jam access door which is substantial in weight is undesirable from the standpoint of usability, since it takes a substantial amount of force to close it.

In order to deal with these issues, various means have been proposed. For example, according to Japanese Laid-open Patent Application No. 2006-284805, the shaft with which the jam access door is rotationally supported is provided with a damper (hinge damper), and a spring-based damper is suspended between the jam access door and the main assembly of an image forming apparatus, in order to slow the movement of the door when the door is opened.

Further, a method for reducing the amount of the aforementioned shock without employing a hinge damper is disclosed in Japanese Laid-open Patent Application No. 2007-279274. According to this patent application, the main assembly of an image forming apparatus is provided with an oil-based damper of the so-called rotary type (oil-based rotary damper), and the jam access door is provided with a pair of arms, which are provided with a rack and are rotationally movable relative to the door. Thus, as the jam access door is opened, the rack of the arm meshes with the pinion gear of the oil-based rotary damper, whereby the opening movement of the door is slowed. Moreover, this structural setup can reduce in size the mechanism for allowing the jam access door to be opened or closed. Further, there is also such a solution that suspends a pneumatic damper of the so-called piston type between the jam access door and the main assembly of the apparatus.

However, if the shaft about which a heavy jam access door is rotated is provided with a hinge damper as disclosed in Japanese Laid-open Patent Application No. 2006-284805, the amount of torque of which the damper is required is substantial. Therefore, a required damper was rather expensive. Further, in the case of the solution disclosed in Japanese Laid-open Patent Application No. 2007-279274, the main assembly of the image forming apparatus was provided with an oil-based rotary damper, and the jam access door is provided with an arm having a rack (toothed portion), in order to slow the movement of the door when the door is opened. In this case, the arm doubled as the means for holding the door in a preset position when the door is open. Therefore, a space in which the arm is stored when the door is closed has to be reserved in the main assembly of the apparatus. Thus, this solution is adverse to the effort to reduce the apparatus in size.

Further, if a jam access door is equipped with a pneumatic damper of the piston-type, the cylinder has to be matched in size to the weight of the jam access door. Thus, employing a pneumatic damper of the piston-type is disadvantageous from the standpoint of space saving. In addition, a pneumatic damper of the piston-type works even when the jam access door is closed. Thus, if a pneumatic damper of the piston-type is employed, a relatively large amount of force is necessary to close the jam access door. The employment of the pneumatic damper of the piston-type is undesirable from the standpoint of usability. As another inexpensive structural means for reducing the speed with which a jam access door opens, there is a method which employs a friction brake. This method, however, was disadvantageous from the stand point of durability.

SUMMARY OF THE INVENTION

This invention was made as one of the solutions to the above described issues. Thus, the primary object of the present invention is to provide an image forming apparatus which is significantly gentler in the manner (speed) with which its jam access door opens, and yet, is smaller in size, less expensive, and more durable than any conventional image forming apparatus.

According to an aspect of the present invention, there is provided an image forming apparatus comprising an openable member rotatable relative to a main assembly of the image forming apparatus; and a supporting member connected between said main assembly of the image forming apparatus and said openable member configured to support said openable member when said openable member is opened, wherein said supporting member includes a first arm member and a second arm member which are slidable relative to each other, a pinion provided on said first arm member, a viscous damper mounted on a rotation shaft of said pinion, a rack provided on said second arm member and engaged with said pinion, and wherein by opening said openable member, relative slide movement is caused between said first arm member and said second arm member so that said pinion engaged with said rack rotates and a braking force is produced by said viscous damper.

Further features of the present invention will become apparent from the following description of exemplary embodiments with reference to the attached drawings.

Figure 4:
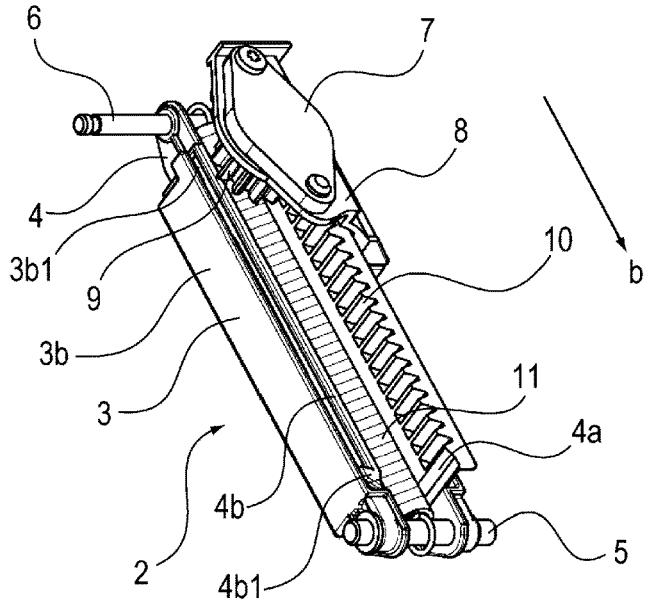
Figure 4:
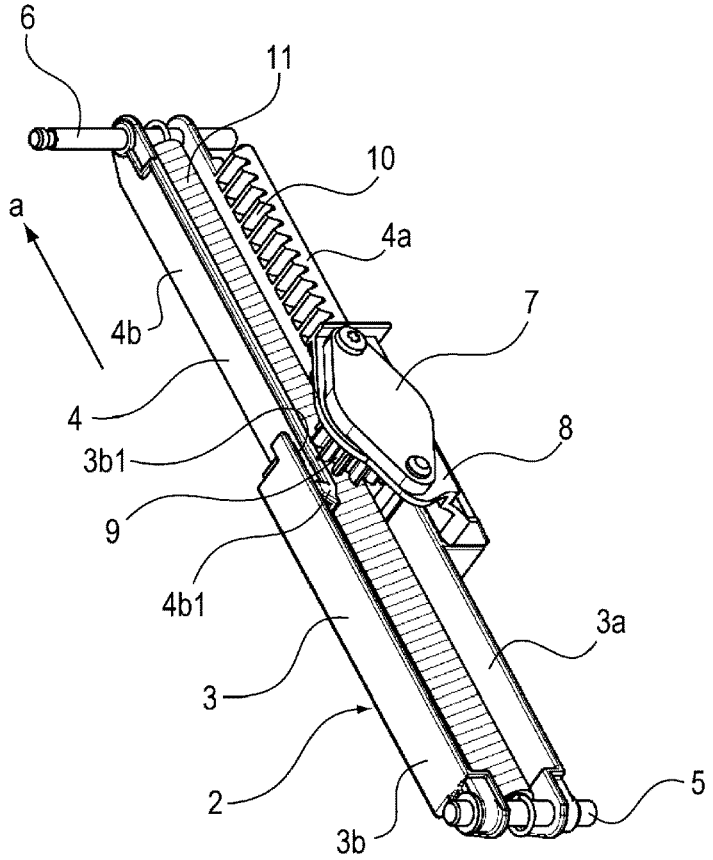

Part (a) of FIG. 4 is a perspective view of the jam access door supporting member in the first embodiment, when the supporting member is in the unextended state, and part (b) of FIG. 4 is a perspective view of the jam access door supporting member, when the supporting member is in the fully extended state.

Figure 5:
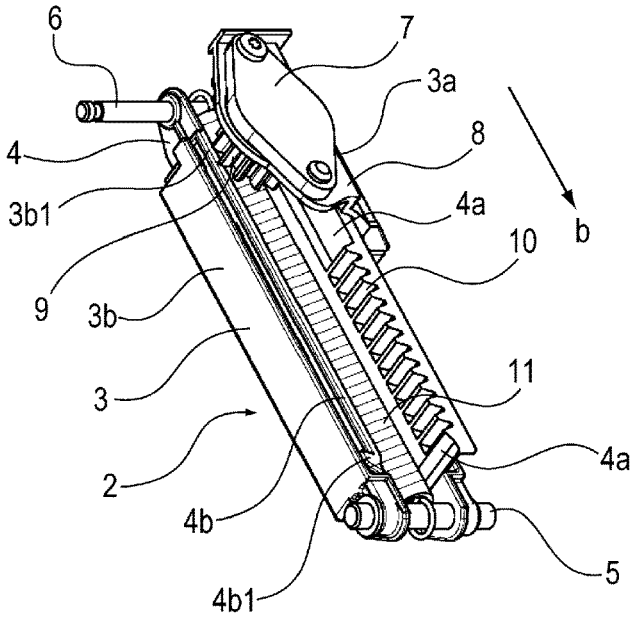
Figure 5:
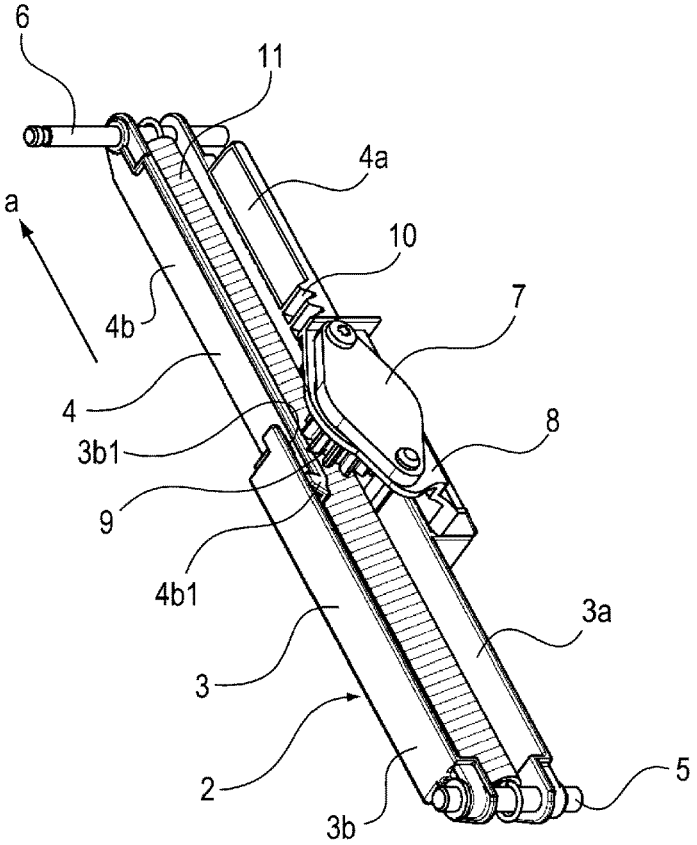

Part (a) of FIG. 5 is a perspective view of the jam access door supporting member in the second embodiment of the present invention, when the supporting member is in the unextended state, and part (b) of FIG. 5 is a perspective view of the jam access door supporting member, when the supporting member is in the fully extended state.

Figure 6:
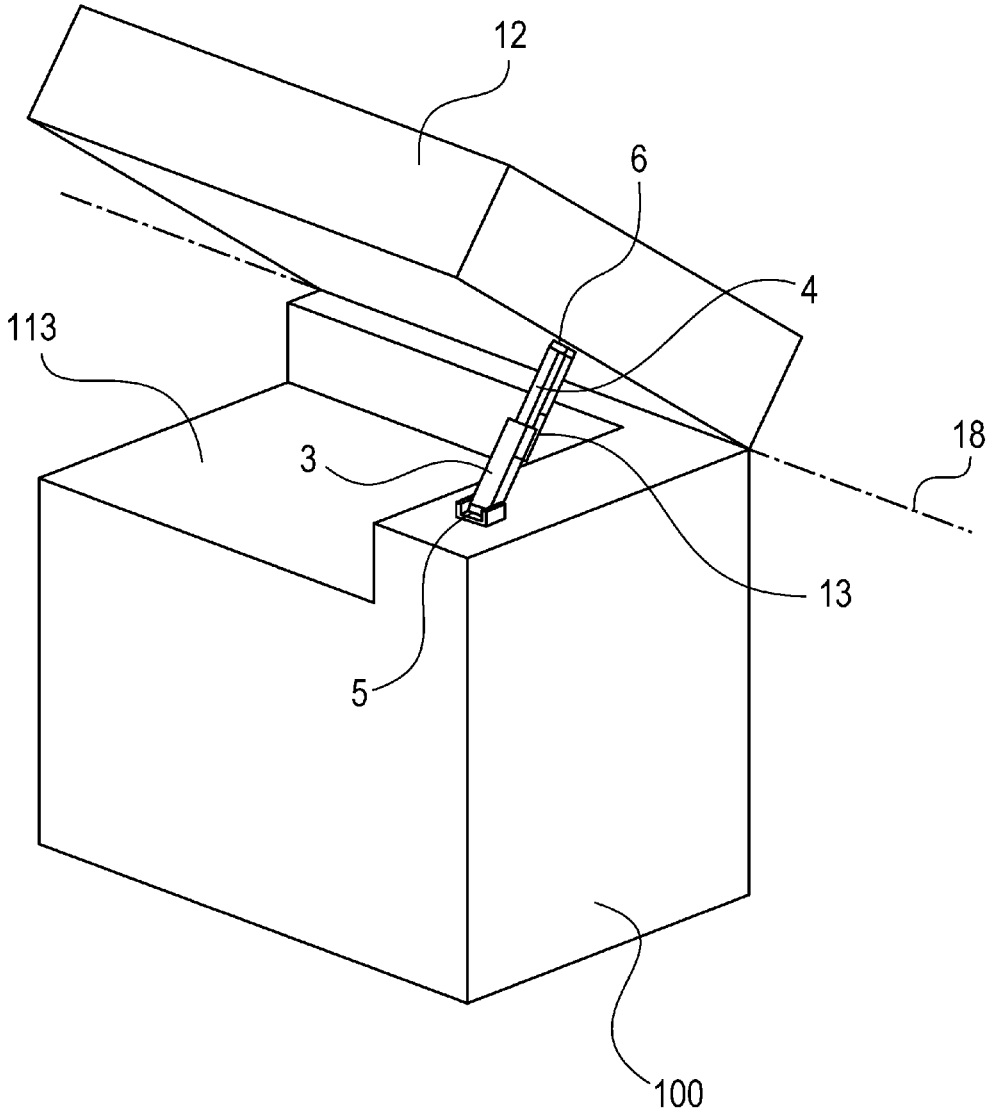

FIG. 6 is a perspective view of the image forming apparatus in the third embodiment of the present invention, and is for showing the structure of the original reading device supporting member placed between the original reading device of the apparatus, and the main assembly of the apparatus.

Figure 7:
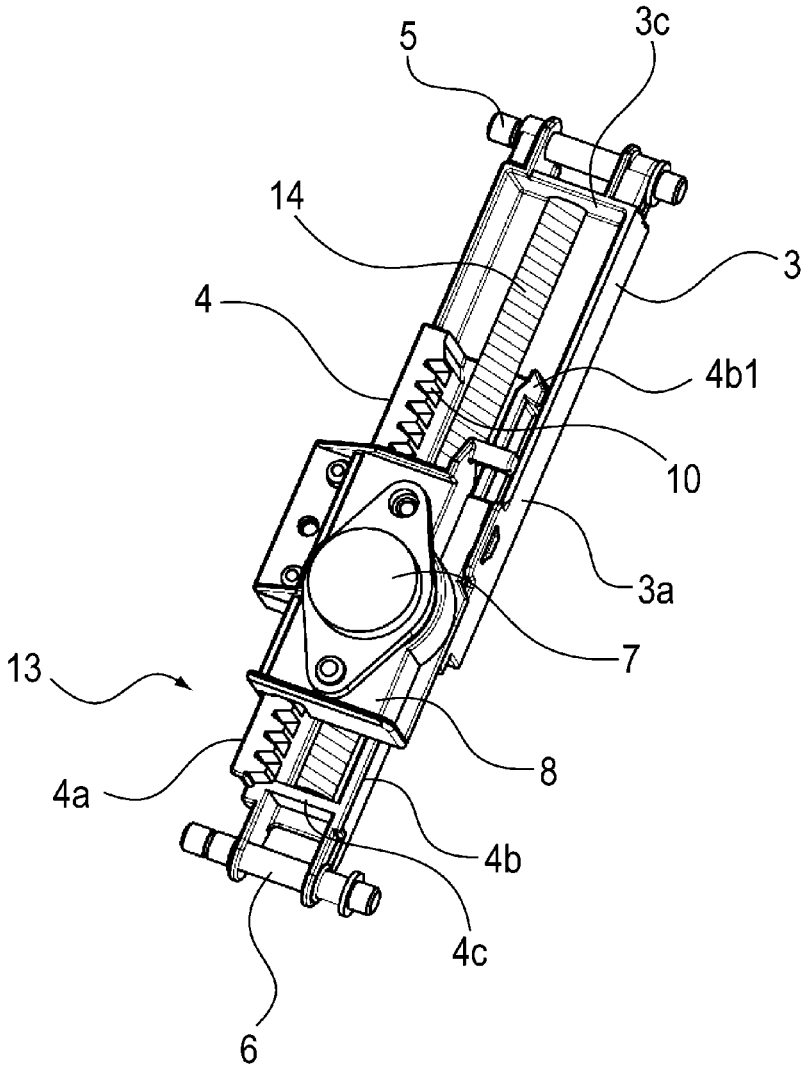

FIG. 7 is a perspective view of the original reading device supporting member in the third embodiment, and for showing the structure of the supporting member.

DESCRIPTION OF THE EMBODIMENTS

Hereinafter, the present invention is concretely described with reference to the image forming apparatuses in a few of the preferred embodiments of the present invention.

Embodiment 1

To begin with, referring to FIGS. 1-4, the structure of the image forming apparatus in the first embodiment of the present invention is described.

<Image Forming Apparatus>

Figure 1:
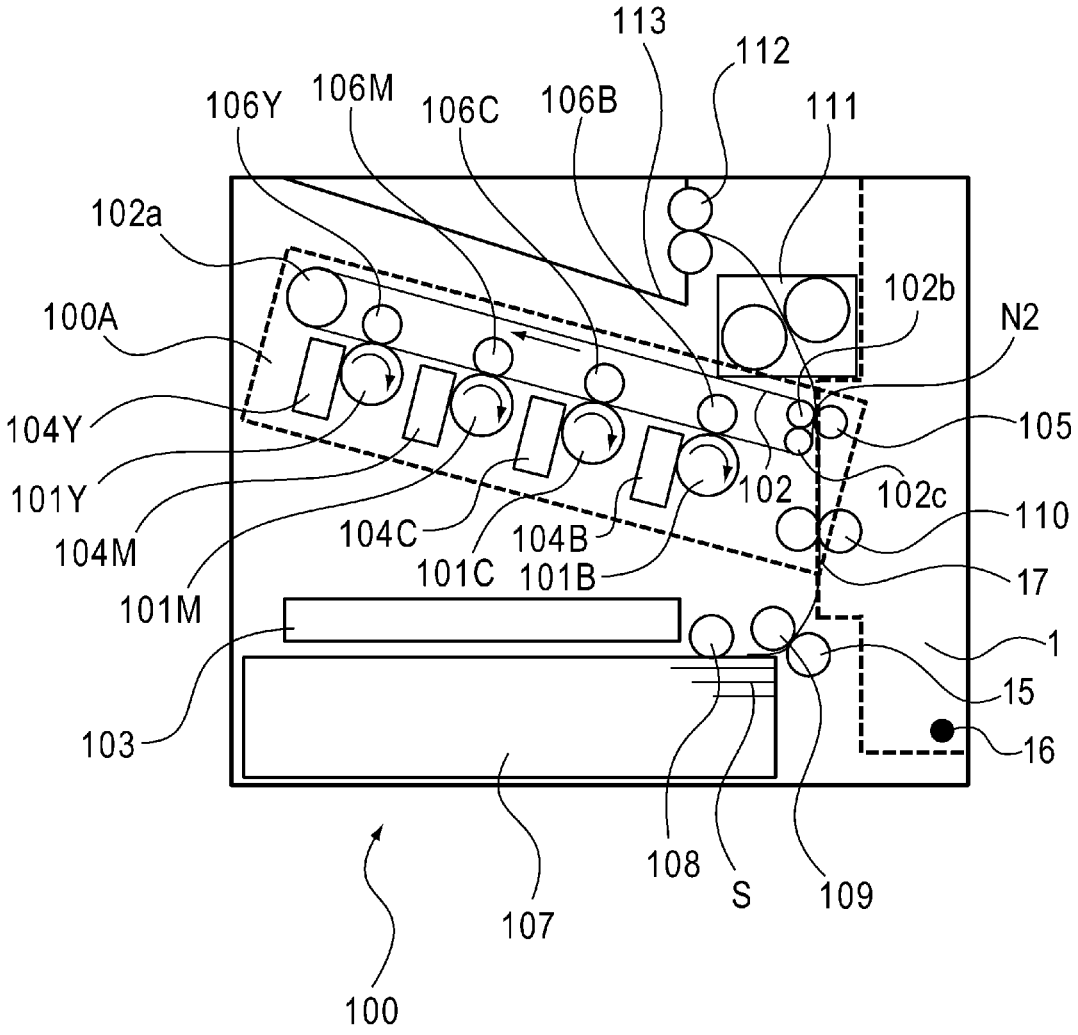
FIG. 1 is a sectional view of an image forming apparatus in accordance with the present invention, when its jam access door is closed.
Figure 2:
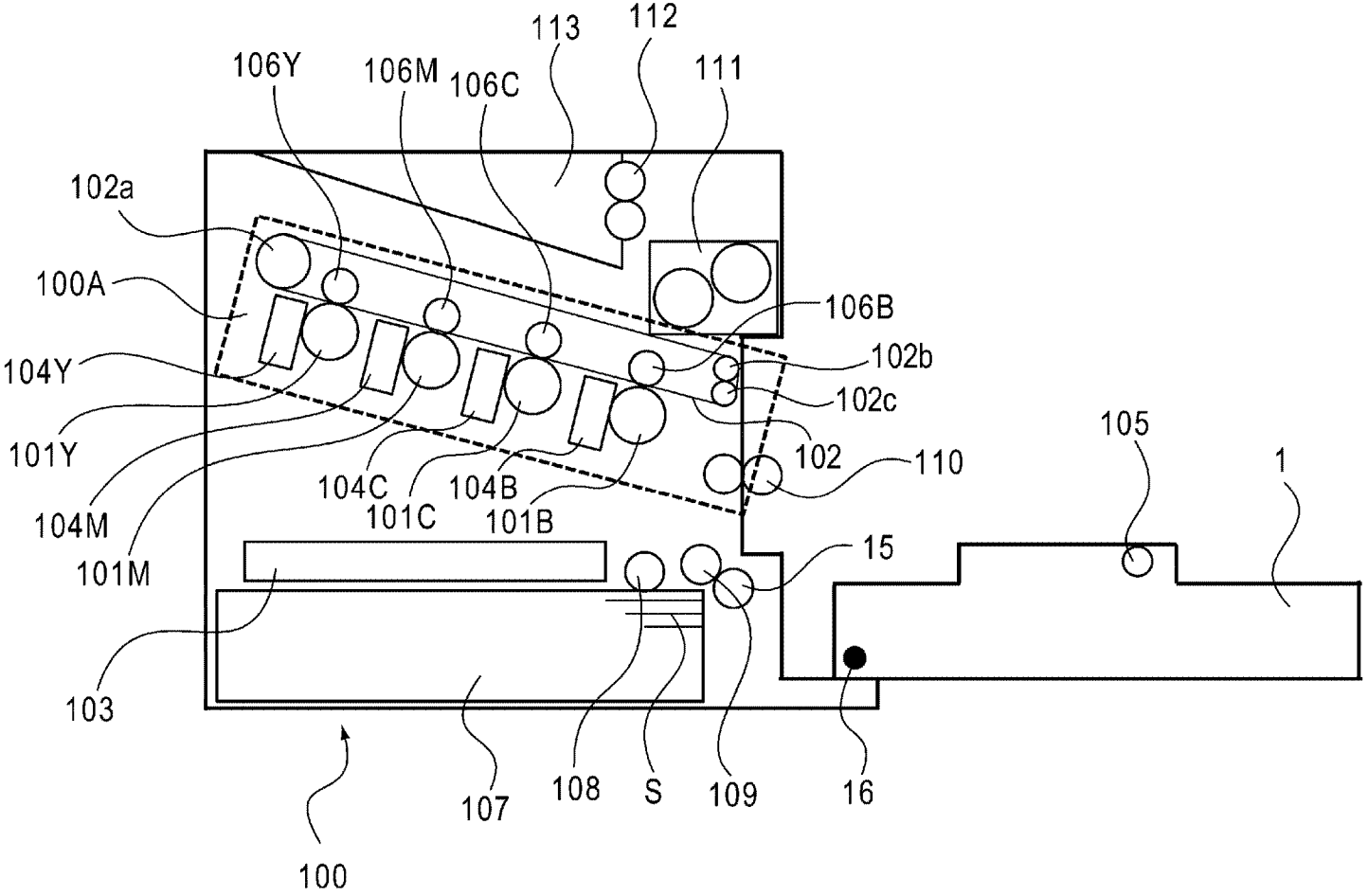
FIG. 2 is a sectional view of the image forming apparatus in accordance with the present invention, when its jam access door is open.

First, referring to FIGS. 1 and 2, the structure of the image forming apparatus 100 is described. The image forming apparatus 100 shown in FIGS. 1 and 2 is an example of a color laser printer. The main assembly of the image forming apparatus 100 is provided with an image forming portion 100A, which forms images with the use of an electrophotographic method.

The image forming portion 100A is provided with four photosensitive drums 101Y, 101M, 101C and 101B, which are image bearing members, on which yellow (Y), magenta (M), cyan (C) and black (B) toner images are formed respectively. By the way, for the sake of descriptive discretion, each of the photosensitive drums 101Y, 101M, 101C and 101B may be described simply as a photosensitive drum 101. This discretion applies also to means for processing the photosensitive drum 101 for image formation. The photosensitive drum 101 rotates clockwise as shown in FIG. 1.

The image forming portion 100A is also provided with an intermediary transfer belt 102, which is endless and serves as an intermediary transferring member. The intermediary transfer belt 102 is placed in contact with the peripheral surface of each photosensitive drum 101 so that the toner image formed on the peripheral surface of the photosensitive drum 101 is transferred (primary transfer) onto the intermediary transfer belt 102. It is suspended and tensioned by rollers 102*a*, 102*b* and 102*c*, being enabled to rotated counterclockwise as shown in FIG. 1.

Further, the image forming portion 100A is provided with four primary transfer rollers 106 which serve as the primary transferring means. Each primary transfer roller 106 is placed in the inward side of a loop (belt loop) which the intermediary transfer belt 102 forms. It forms the primary transfer nip between the intermediary transfer belt 102 and the peripheral surface of the photosensitive drum 101, by being pressed against the peripheral surface of the corresponding photosensitive drum 101. Further, it generates difference in potential between the photosensitive drum 101 and intermediary transfer belt 102. More concretely, as the primary transfer bias is applied to the primary transfer roller 106, the toner image formed on the peripheral surface of the photosensitive drum 101 is transferred (primary transfer) onto the outward surface of the intermediary transfer belt 102.

Referring to FIG. 2, the main assembly of the image forming apparatus 100 is provided with a jam access door 1, which is a member supported by a horizontal shaft 16, with which the main assembly is provided, in such a manner that it is pivotally movable about the shaft 16. The jam access door 1 is provided with the secondary transfer roller 105, as the secondary transferring means, which is rotatably attached to the jam access door 1.

Referring to FIG. 1, the jam access door 1 is closed relative to the main assembly of the image forming apparatus 100. When the jam access door 1 is in the state shown in FIG. 1, the secondary transfer roller 105, with which the jam access door 1 is provided, forms the secondary transfer nip N2 between itself and the outward surface of the intermediary transfer belt 102 of the main assembly of the image forming apparatus 100.

Figure 3:
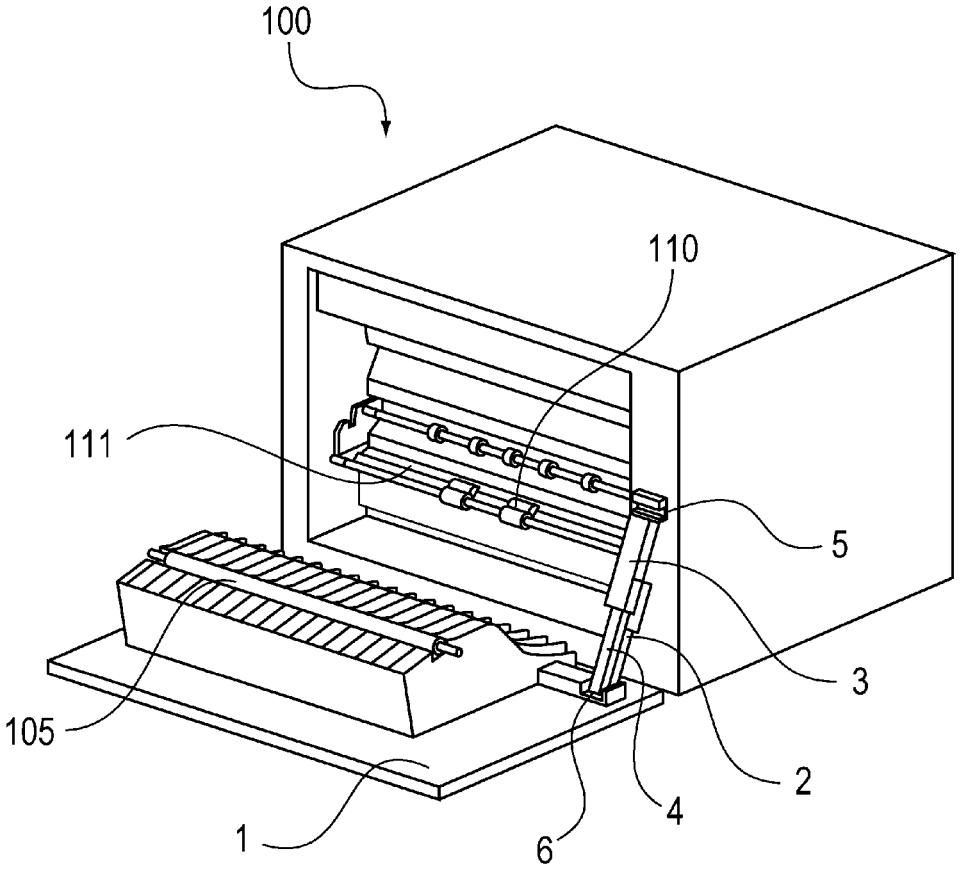
FIG. 3 is a perspective view of the image forming apparatus in the first embodiment of the present invention, when its jam access door is open. It is for showing the structure of the jam access door supporting member placed between the jam access door and the main assembly of the image forming apparatus.

Meanwhile, the topmost of the sheets S of recording medium stored in a sheet feeder cassette 107 is moved out of the cassette 107 by a feed roller 108 while being separated from the rest by a combination of a feed roller 109 which rotates in the same direction as the direction in which the sheet S of recording medium is conveyed, and a retard roller 15 which rotates in the opposite direction from the sheet conveyance direction. Referring to FIGS. 2 and 3, a pair of registration rollers 109 is a part of the main assembly of the image forming apparatus 100.

As the topmost of the sheets S of recording medium in the sheet feeder cassette 107 is moved out of the cassette 197 along with a few of the sheets S which were under the topmost sheet, it is separated from the rest by the combination of the feed roller 109 and retard roller 15. Then, it is sent to the nip of the pair of registration rollers 110, while the pair of registration rollers 110 are kept stationary, in such a manner that causes the leading edge of the sheet S to bump into the nip. As the sheet S bumps into the nip N, it is corrected in attitude by its own resiliency. Thereafter, the sheet S is sent, with preset timing, to the secondary transfer nip N2 by the pair of registration rollers 110 while remaining pinched between the two rollers 110.

<Image Forming Operation>

As an image forming operation is started in the image forming portion 100A, each photosensitive drum 101 begins to be rotated in the clockwise direction indicated in FIG. 1. As the photosensitive drum 101 rotates, its peripheral surface is uniformly charged by an unshown charge roller 2, which functions as a charging means. Then, the uniformly charged portion of the peripheral surface of the photosensitive drum 101 is scanned by a beam of laser light emitted by a laser scanner 103, which functions as an exposing means, while being modulated with image formation signals. As a result, an electrostatic latent image, which reflects the image formation signals, is formed on the peripheral surface of each photosensitive drum 101.

Then, the electrostatic latent image formed on the peripheral surface of each photosensitive drum 101 is developed into a toner image by being supplied with one of four toners, different in color, by the corresponding developing device 104, which functions as a developing means. The four toner images, different in color, formed on the peripheral surfaces of the four photosensitive drums 101, one for one, are sequentially transferred in layers (primary transfer) onto the outward surface of the intermediary transfer belt 102, by the four primary transfer rollers 106, one for one, while the intermediary transfer belt 102 is rotationally moved in the counterclockwise direction indicated in FIG. 1. The four toner images, different in color, transferred in layers onto the outward surface of the intermediary transfer belt 102 are conveyed to the secondary transfer nip N2.

Meanwhile, the sheet S moved out of the sheet feeder cassette 107 by the feed roller 108 is conveyed further into the main assembly of the image forming apparatus 100 while being separated from the rest of the sheets S in the cassette 107, and then, is made to bump into the nip of the pair of registration rollers 110 which is being temporarily kept stationary, by its leading edge, being thereby corrected in attitude. Thereafter, it is conveyed further by the pair of registration rollers 110, while remaining pinched between the pair of registrations 110, to the secondary transfer nip N2 formed by the outward surface of the intermediary transfer belt 102 and the peripheral surface of the secondary transfer roller 105.

The sheet S of recording medium is conveyed to the second transfer nip portion N2 by the pair of registration rollers 110 with the same timing as the timing with which the toner images formed on the outward surface of the intermediary transfer belt 102 move into the secondary transfer nip portion N2. Then, it is conveyed through the secondary transfer nip portion N2. As the sheet S of recording medium is conveyed through the secondary transfer nip portion N2, the secondary transfer bias is applied to the secondary transfer roller 105. Thus the toner images transferred (primary transfer) onto the outward surface of the intermediary transfer belt 102 are transferred together (secondary transfer) onto the sheet S.

In terms of the direction in which the sheet S of recording medium is conveyed, the position of the sheet S has to be made to coincide with those of the toner images formed on the outward surface of the intermediary transfer belt 102. Thus, the image forming apparatus 100 is provided with an unshown CPU (central processing unit) which functions as a controlling means. The CPU controls the speed with which the sheet S is conveyed by the pair of registration rollers 110 and the feed roller 109 by controlling the driving of an unshown motor, which serves as a driving force source. This is how the timing with which the sheet S arrives at the secondary transfer nip portion N2 is synchronized with the timing with which the toner images on the intermediary transfer belt 102 arrive at the secondary transfer nip portion N2.

The toner images borne on the outward surface of the intermediary transfer belt 102 are transferred onto the sheet S by the application of the secondary transfer bias to the secondary transfer roller 105, in the secondary transfer nip portion N2. After the transfer of the toner images onto the sheet S, the sheet S is conveyed to a fixing device 111, which functions as a fixing means. Then, the sheet S is conveyed through the fixing device 111 while remaining pinched between the fixation roller and pressure roller with which the fixing device 111 is provided. While the sheet S is conveyed through the fixing device 111 while remaining pinched between the fixation roller and pressure roller, the sheet S is heated and pressed. As a result, the toner images on the sheet S melt, and become fixed to the sheet S as they cool down. After the fixation of the toner images to the sheet S, the sheet is conveyed further by a pair of discharge rollers 112 while remaining pinched between the two discharge rollers 112, and then, is discharged into a delivery portion 113, which makes up a part of the top portion of the image forming apparatus 100.

<Jam Access Door>

Next, referring to FIGS. 1-3, the structure of the jam access door 1, which can be opened or closed relative to the main assembly of the image forming apparatus 100 is described. The main assembly of the image forming apparatus 100 is provided with a horizontal shaft 16, shown in FIGS. 1 and 2, and the jam access door 1 is supported by the horizontal shaft 16 in such a manner that it can be pivotally moved about the shaft 16. It sometimes occurs that while a sheet S of recording medium (such as paper) is conveyed through a recording medium passage in the image forming apparatus 100, it gets stuck in the passage, jamming thereby the apparatus. As the image forming apparatus 100 is jammed by the sheet S, the sheet S has to be removed, and therefore, the jam access door 1 is opened by a user as shown in FIG. 2. As the jam access door 1 is opened, a portion 17 of the recording medium passage, which is between the adjacencies of the pair of registration rollers 110 and the secondary transfer nip portion N2, becomes fully exposed.

As the jam access door 1 is opened to expose the portion 17 of the recording medium passage, it is held by a supporting member 2 at a preset angle relative to the main assembly of the image forming apparatus 100. That is, one end of the supporting member 2 is connected to the main assembly of the image forming apparatus 100, and the other end is connected to the jam access door 1, so that the supporting member 2 can regulate the jam access door 1 in the position, relative to the main assembly, in which the jam access door 1 is held when the door 1 is fully open, as shown in FIG. 3.

<Supporting Member>

Next, referring to FIG. 4, the structure of the supporting member 2 which supports the jam access door 1 so that the jam access door 1 can be opened or closed relative to the main assembly of the image forming apparatus 100 is described.

Referring to parts (a) and (b) of FIG. 4, the supporting member 2 is made up of the first and second arms 3 and 4, which are U-shaped in cross-section. It is structured so that the two arms 3 and 4 are allowed to move relative to each other in a manner of sliding in contact with each other. More specifically, the second arm 4 fits in the first arm 3 in such a manner that they are allowed to slidingly move relative to each other. Thus, the supporting member 2 can extend or shorten. In other words, the supporting member 2 is enabled to change in length as shown in parts (a) and (b) of FIG. 4.

The first arm 3 is attached to the main assembly of the image forming apparatus 100 so that it can rotationally move about the first shaft 5 with which the main assembly is provided, whereas the second arm 4 is attached to the jam access door 1 so that it can rotate about the second shaft 6 with which the jam access door 1 is provided. As the jam access door 1 is closed relative to the main assembly of the image forming apparatus 100 as shown in FIG. 1, the second arm 4 retracts into the first arm 3, and therefore, the supporting member 2 reduces in length.

On the other hand, as the jam access door 1 is opened relative to the main assembly of the image forming apparatus 100 as shown in FIGS. 2 and 3, the second arm 4 slides out of the first arm 3 in the direction indicated by an arrow mark b as shown in part (a) of FIG. 4. Thus, the supporting member 2 increases in length.

Referring to part (b) of FIG. 4, the second arm 4 is provided with a pawl **4*b*1, which protrudes outward, in terms of the direction perpendicular to the lengthwise direction of the second arm 4, from the opposite end of the lateral wall 4*b* of the second arm 4 from the shaft 6, in terms of the lengthwise direction of the second arm 4, whereas the first arm 3 is provided with a pawl 3*b*1, which protrudes inward of the first arm 3, in terms of the direction perpendicular to the lengthwise direction of the first arm 3, from the opposite end of the lateral wall 3*b* of the first arm 3, from the shaft 5. Thus, as the jam access door 1 is opened so that the angle between itself and the main assembly of the image forming apparatus 100 becomes a preset one as shown in FIG. 3, the pawl 4*b*1 engages with the pawl 3*b*1, whereby the supporting member 2 is prevented from extending further, and holds the jam access door 1, in the position in which the two pawls 4*b*1 and 3*b*1** engaged with each other.

Referring to parts (a) and (b) of FIG. 4, the first arm 3 is provided with a viscosity-based rotary damper 7, which is attached to the opposite end of the first arm 3, in terms of the lengthwise direction of the supporting member 2, of the opposite lateral wall **3*a* of the first arm 3 from the lateral wall 3*b*, with the placement of a damper holder between the lateral wall 3*a* and hydraulic damper 7. The viscosity-based rotary damper 7 is made up of a housing, viscous fluid such as oil, filled in the housing, and a rotor placed in the viscous fluid. It is structured so that the rotation of the rotor is damped by the viscosity of the viscous fluid. The viscosity-based rotary damper 7 is provided with a pinion gear 9, which is attached to the rotational shaft of the unshown rotor of the viscosity-based rotary damper 7, so that the rotor is rotated by the rotation of the pinion gear 9. The pinion gear 9 is attached to the first arm 3**.

On the other hand, the second arm 4 is provided with a rack 10, which is on the inwardly facing side of the aforementioned lateral wall **4*a*. The rack 10 extends from one lengthwise end of the lateral wall 4*a* to the other. The rack 10 with which the second arm 4 is provided is meshed with the pinion gear 9 with which the first arm 3 is provided. Thus, as the jam access door 1 is opened, the first arm 3 is moved relative to the second arm 4 in the direction indicated by an arrow mark b in part (a) of FIG. 4, increasing thereby the supporting member 2 in length, whereas as the jam access door 1 is closed, the first arm 3 is moved relative to the second arm 4 in the direction indicated by an arrow mark a in part (b) of FIG. 4, reducing thereby the supporting member 2 in length. As the second arm 4 is moved in the direction indicated by the arrow mark a or b, the pinion gear 9 which is meshed in mesh with the rack 10 is rotated by the movement of the second arm 4 (rack 10**).

The viscosity-based rotary damper 7 in this embodiment is a one-way damper, which damps the rotation of a rotor only when the rotor rotates in one direction. A one-way damper such as the one employed in this embodiment is provided with a one-way clutch, which is placed between the rotor which is subjected to the resistance attributable to the viscosity of viscous fluid, and the shaft of the rotor.

As for choices of one-way clutch, a sprag clutch, for example, can be employed. A one-way clutch of the sprag type is made up of an external ring (outer lath), an internal ring (inner lath), and a sprag (locking means) placed between the outer and inner rings. As the outer lath rotates in one direction relative to the inner lath, the sprag locks the outer and inner lathes relative to each other, enabling the outer lath to transmit torque from itself to the inner lath, whereas as the outer lath rotates in the other direction, the sprag does not lock the outer and inner lathes relative to each other, and therefore, torque is not transmitted.

As another choice of one-way clutch, a cam-based one-way clutch can be employed. A cam-based one-way clutch is made up of an outer ring, an inner ring, a roller, and a spring. The inward surface of the outer ring, or the outer surface of the inner ring, is provided with a pocket having such a surface that works like the surface of as a cam. The roller is placed in the pocked, being held by the spring so that the surface of the outer ring, which is contoured like the surface of a cam, and the outward surface of the inner ring, are kept in contact with each other by the spring, or that the surface of the inner ring cam, which contoured like the surface of a cam, and the inward surface of the outer ring, are kept in contact with each other by the spring. Thus, as the outer rings begins to rotate in one direction relative to the inner ring, the contact pressure between the cam-like surface and the corresponding ring increases, increasing thereby the friction between the cam-like surface of the corresponding ring. Thus, driving force is transmitted from the outer ring to the inner ring. On the other hand, as the outer ring rotates in the opposite direction, the contact pressure between the cam-like surface and the corresponding roller reduces, reducing thereby the friction between the cam surface and the corresponding roller. Consequently, the outer roller slips relative to the inner ring, and therefore, driving force is not transmitted from the outer ring to the inner ring.

With the supporting member 2 being structured as described above, it is only when the supporting member 2 is extended, that is, when the second arm 4 is made to slide out of the first arm 3 by the opening movement of the jam access door 1 as shown in part (b) of FIG. 4, that the rotor of the viscosity-based rotary damper, which rotates with the pinion gear 9, is subjected to the hydraulic resistance attributable to the viscous fluid, and therefore, the damper 7 generates damping (braking) force.

That is, as the jam access door 1 is opened relative to the main assembly of the image forming apparatus 100, the second arm 4, which is rotationally supported by the second shaft 6 attached to the jam access door 1 by one of its lengthwise ends, slides out of the first arm 3 which is rotationally supported by the first shaft 5 attached to the main assembly of the image forming apparatus 100 by one of its lengthwise ends. As the second arm 4 slides out of the first arm 3, the pinion gear 9, which is in mesh with the rack 10 with which the second arm 4 is provided, is rotated by the movement of the rack 10 (second arm 4). However, the pinion gear 9 is in the viscous fluid of the viscosity-based rotary dumper 7. Thus, the rotation of the pinion gear 9 is damped; the pinion gear 9 is controlled in rotational speed.

Thus, the inertia which would have accelerated the speed with which the jam access door 1 opens as the jam access door 1 is unlatched from the main assembly of the image forming apparatus 100 is damped by the viscosity-based rotary damper 7. The viscosity-based rotary damper 7 in this embodiment is a one-way damper. Thus, it is only when the jam access door 1 is opened relative to the main assembly of the image forming apparatus 100 that the rotation of the pinion gear 9 is subjected to the damping (braking) force from the viscosity-based rotary damper 7.

On the other hand, when the jam access door 1 is closed relative to the main assembly of the image forming apparatus 100, the rotation of the pinion gear 9 is not subjected to the braking force from the viscosity-based rotary damper 7. That is, it does not occur that when the jam access door 1 is closed by a user, it is subjected to an unnecessary amount of load from the viscosity-based rotary damper 7. Therefore, a user can close the jam access door 1 with the application of only a small amount of force to the door 1. That is, this embodiment can improve the image forming apparatus 100 in usability.

The supporting member 2 is provided with a damper spring 11, as the pressure (tension) generating first member, which is suspended between the first shaft 5 attached to one of the lengthwise ends of the first arm 3, and the second shaft 6 attached to one of the lengthwise ends of the second arm 4. The damper spring 11 is encased in a combination of the first and second arms 3 and 4, which are U-shaped in cross-section. The damper spring 11 in this embodiment is a tension spring.

The damper spring 11 (pressure (tension) generating first member) generates tensional force between the first and second arms 3 and 4. Thus, when the jam access door 1 is opened relative to the main assembly of the image forming apparatus 100, such tensional force that works in the direction to close the jam access door 1 is generated by the damper spring 11.

The damper spring 11, first shaft 5, and second shaft 6 in this embodiment are electrically conductive. Thus, electricity can conduct from the first shaft 5 to the second shaft 6, and vice versa. The first shaft 5 is electrically in connection to the electrically conductive metallic plate frame of the main assembly of the image forming apparatus 100, being thereby grounded to the main assembly. As for the second shaft 6, it is electrically in connection to the unshown grounding plate (grounding means) for electrical components such as electric switches, attached to the jam access door 1. The grounding plate (grounding means) protects electrical components such as electrical switches with which the jam access door 1 is provided.

Further, the damper spring 11, which is electrically conductive, is suspended between the shafts 5 and 6 by the first and second shafts 5 and 6, while remaining electrically in contact with the two shafts 5 and 6. Thus, a grounding passage is formed between the jam access door 1 and main assembly of the image forming apparatus 100 by the damper spring 11 (pressure (tension) generating first means). Therefore, the electrical components such as electrical switches with which the jam access door 1 is provided are grounded to the main assembly of the image forming apparatus 100 by way of the damper spring 11 (pressure (tension) generating first means), whereby various electrical components with which the jam access door 1 is provided are safeguarded against static electricity.

In this embodiment, both the damper spring 11 and viscosity-based rotary damper 7 are used to partially cancel the force generated by the weight of the jam access door 1 itself in the direction to rotate the jam access door 1 in the opening direction. Therefore, the amount of damping force required of the viscosity-based rotary damper 7 is minimized. Therefore, only a small and inexpensive viscosity-based rotary damper 7 can be employed to reduce the inertia which is generated in the jam access door 1 as it is allowed to downwardly open by the unlatching of the jam access door 1 from the main assembly of the image forming apparatus 100.

Further, the generation of such force that works in the direction to dampen the inertia which works in the direction to open the jam access door 1 is dependent upon the combination of the tensional force of the damper spring 11 and the viscosity of the viscous fluid in the viscosity-based rotary damper 7. Thus, the supporting member 2 in this embodiment is advantageous from the standpoint of durability, since the jam access door 1 is repeatedly opened or closed throughout the life span of the image forming apparatus 100. Further, the tensional force generated by the damper spring 11 works in the direction indicated by the arrow mark a in part (b) of FIG. 4, that is, the direction to close the jam access door 1. That is, when a user closes the jam access door 1, the tensional force generated by the damper spring 11 functions as an assistant to reduce the amount of force required of the user to close the jam access door 1. Therefore, the image forming apparatus 100 in this embodiment is superior in terms of usability than any image forming apparatus equipped with any conventional the supporting member 2.

Further, the supporting member 2 includes: the first arm 3, second arm 4, first shaft 5, second shaft 6, viscosity-based rotary damper 7, pinion gear 9, and rack 10. Thus, these components do not need to be separately removed when the jam access door 1 is serviced or replaced. Thus, this embodiment can make it easier to assemble or disassemble the jam access door 1.

Embodiment 2

Next, referring to FIG. 5, the structure of the image forming apparatus in the second embodiment of the present invention is described. By the way, the portions of the image forming apparatus in this embodiment which are the same in structure as the counterparts in the first embodiment are given the same referential codes as those given to the counterparts, one for one, and are not described here. Further, even if a given portion of the image forming apparatus in the second embodiment has a referential code which is different from the one given to the counterpart in the first embodiment, it is not described here, as long as it is the same in structure as the counterpart. Part (a) of FIG. 5 is a perspective view of the supporting member 2 in this embodiment when the supporting member 2 is in the unextended state, whereas part (b) of FIG. 5 is a perspective view of the supporting member 2 in this embodiment when the supporting member 2 is in the fully extended state.

In part (a) of FIG. 5, the supporting member 2 is in the state in which the jam access door 1 is closed relative to the main assembly of the image forming apparatus 100 as shown in FIG. 1. In part (b) of FIG. 5, the supporting member 2 is in the state in which the jam access door 1 is open relative to the main assembly of the image forming apparatus 100 as shown in FIGS. 2 and 3.

The supporting member 2 in this embodiment is made up of the first arm 3, second arm 4, first shaft 5, second shaft 6, damper holder 8, viscosity-based rotary damper 7, pinion gear 9, and rack 10. The supporting member 2 and damper spring 11 are integral parts of a supporting unit. These portions of the supporting member 2 are the same in structure and operation as the counterparts in the first embodiment. Therefore, they are not described here in order not to repeat the same descriptions.

In the first embodiment described above, the rack 10 which is the inward side of the lateral wall 4*a* of the second arm 4, covered roughly the entirety of the inward side of the lateral wall 4*a* in terms of the lengthwise direction of the lateral wall 4*a* as shown in parts (a) and (b) of FIG. 4. In this embodiment, the second arm 4 is structured so that, in terms of the lengthwise direction of the second arm 4, only a part of the inward side of the lateral wall 4*a* is covered with a rack 10 as shown in parts (a) and (b) of FIG. 5. That is, the rack 10 has a preset length in terms of the lengthwise direction of the lateral wall 4*a*; the portion of the inward side of the lateral wall 4*a*, which is adjacent to the second shaft 6 is not toothed.

That is, referring to part (a) of FIGS. 5 and 5(*b*), in this embodiment, in terms of the direction in which the first and second arms 3 and 4 slidingly move relative to each other, only a part of the inward side of the lateral wall 4*a* of the second arm 4 is toothed (rack 10). The toothed portion (rack portion 10) of the inward side of the lateral wall 4*a* of the second arm 4 meshes with the pinion gear 9 with which the lateral wall 3*a* of the first arm 3 is provided.

Thus, when the jam access door 1 remains closed relative to the main assembly of the image forming apparatus 100 as shown in FIG. 1, the state of the supporting member 2 is as follows. Referring to part (a) of FIG. 5, the toothed portion (rack portion 10) of the lateral wall 4*a* of the second arm 4 has moved past the pinion gear 9 with which the first arm 3 is provided, and therefore, is not meshed with the pinion gear 9.

Further, the rack portion 10 of the inward side of the lateral wall 4*a* of the second arm 4 begins to mesh with the pinion gear 9 while the jam access door 1 is opened as shown in FIG. 3. It is at this moment when the rack portion 10 begins to mesh with the pinion gear 9 as shown in part (b) of FIG. 5 that the viscosity-based rotary damper 7 begins to generate such force that dampen the rotation of the pinion gear 9.

Referring to FIG. 3, while the jam access door 1 is opened, the gravitational center of the jam access door 1 is made to shift by the weight of the jam access door 1 itself in the direction to cause rotational moment in the jam access door 1 to shift in the direction to open the jam access door 1. While the gravitational center of the jam access door 1 shifts, the rack portion 10 of the second arm 4 meshes with the pinion gear 9 of the first arm 3, and rotates the pinion gear 9. Therefore, the viscosity-based rotary damper 7 generates such force that dampens the rotation of the pinion gear 9.

That is, in this embodiment, it is only when the jam access door 1 is in the portion of its rotational (pivotal) range, in which such force that can dampen the inertia (speed) with which the jam access door 1 opens is needed that the viscosity-based rotary damper 7 is activated to dampen the inertia which works in the direction to close the jam access door 1. Therefore, it is possible to eliminate the issue that the image forming apparatus 100 is undesirable in terms of usability when the jam access door 1 is in the portion of its rotational (pivotal) range, which is right after it begins to be opened. Otherwise, the supporting member 2 in this embodiment is the same in structure, and can provide the same effect as those obtainable by the supporting member 2 in the first embodiment.

Embodiment 3

Next, referring to FIGS. 6 and 7, the structure of the image forming apparatus in the third embodiment of the present invention is described. By the way, the portions of image forming apparatus in this embodiment, which are the same in structure as the counterparts in the first embodiment are assigned the same referential codes as the counterparts, and are not described here. Further, even if a given portion of the image forming apparatus in this embodiment is different in referential code from the counterpart in the preceding embodiments, it is not described as long as it is the same in structure as the counterpart. FIG. 6 is a perspective view of the image forming apparatus 100 in this embodiment, which has a device 12 (scanner) for reading an original. It is for describing the structure of the supporting member 13 of the apparatus 100 which is disposed between the original reading device 12 and main assembly of the image forming apparatus. FIG. 7 is a perspective view of the supporting member 13 in this embodiment. It shows the structure of the supporting member 13.

Referring to FIG. 3, in each of the preceding embodiments, the supporting member 2 was disposed between the jam access door 1 and the main assembly of the image forming apparatus 100 to support the jam access door 1 when the jam access door 1 is opened to expose the recording medium conveyance passage of the apparatus 100 in order to deal with a paper jam. In this embodiment, the image forming apparatus 100 is provided with the original reading device 12, which can be pivotally moved about a horizontal shaft 18, with which the main assembly of the image forming apparatus 100 is provided, as shown in FIG. 6. Further, the image forming apparatus 100 is provided with the supporting member 13 which is disposed between the original reading device 12 and the main assembly of the image forming apparatus 100, to hold the original reading device 12 in a preset position after the original reading device 12 is moved into the preset position as shown in FIG. 6.

The image forming apparatus 100 shown in FIG. 6 is provided with the original reading device 12, which is supported by the unshown horizontal shaft, which is located at the top edge of the rear wall of the main assembly of the image forming apparatus 100, in such a manner that the original reading device 12 can be pivotally opened or closed about the shaft 18. After the transfer of the toner images onto a sheet S of recording medium in the image forming portion 100A shown in FIG. 1, the sheet S is conveyed through the fixing device 111 so that the toner images are thermally fixed to the sheet S. Thereafter, the sheet S is discharged onto a delivery portion 113 by a pair of discharge rollers 112. Thus, this image forming apparatus 100 is structured so that the original reading device 12 can be pivotally tilted upward about the aforementioned horizontal shaft 18 to make it easier for a user to pick up the discharged sheet S. Referring to FIG. 6, as the original reading device 12 is upwardly tilted, it is held in the tilted (open) position by the supporting member 13.

<Supporting Member>

Referring to FIG. 7, the supporting member 13 in this embodiment has a combination of the first and second arms 3 and 4 which are slidingly movable relative to each other. The supporting member 13 is provided with also a compression spring 14, which is between the first and second arms 3 and 4 in terms of the lengthwise direction of the supporting member 13. The compression spring 14 functions as the pressure generating second member which generates such force that works in the direction to extend the supporting member 13. One of the lengthwise ends of the compression spring 14 is in contact with the end wall 3*c* of the first arm 3, which is perpendicular to the aforementioned lateral wall 3*a* of the first arm 3, whereas the other end of the compression spring 14 is in contact with the end wall 4*c* of the second arm 4, which is perpendicular to the lateral wall 4*a* mentioned in the foregoing.

Referring to FIG. 6, the resiliency of the compression spring 14 shown in FIG. 7 generates such force that works in the direction to extend the supporting member 13, that is, the direction to increase the distance between the end wall 3*c* of the first arm 3 and the end wall 4*c* of the second arm 4. That is, the pressure generated by the compression spring 14 (pressure generating second member) works in the direction to assists the opening (tilting) movement of the original reading device 12 when the original reading device 12 (pivotally movable member) is opened (tilted) relative to the main assembly of the image forming apparatus 100.

Referring to FIG. 7, the first arm 3 of the supporting member 13 is U-shaped in cross-section, and has the lateral wall 3*a*, which is one of the two lateral walls which are parallel to the lengthwise direction of the first arm 3. Further, the first arm 3 is provided with a viscosity-based rotary damper 7, which is attached to the lateral wall 3*a*, with the placement of a damper holder 8 between the lateral wall 3*a* and the viscosity-based rotary damper 7. The viscosity-based rotary damper 7 is provided with a rotor, which is subjected to the resistance from the viscous fluid in the viscosity-based rotary damper 7. To the rotational shaft of the rotor, the above described pinion gear 9, shown in FIGS. 4 and 5, is fixed.

On the other hand, the lateral wall 4*a*, which is one of the two lateral walls of the second arm 4, is roughly entirely toothed on the inward side (rack 10). One of the lengthwise ends of the first arm 3 is provided with the first shaft 5, whereas, in terms of the lengthwise direction of the supporting member 13, the opposite end of the second arm 4 from the shaft 5 of the first arm 3 is provided with the shaft 6. Referring to FIG. 6, the first arm 3 is attached to the main assembly of the image forming apparatus 100 so that it can be rotationally moved about the first shaft 5, whereas the second arm 4 is attached to the original reading device 12 so that it can be rotationally moved about the second shaft 6.

The original reading device 12 is latched to the image forming apparatus 100 with the use of an unshown latch. As the original reading device 12 is unlatched from the image forming apparatus 100, it is tilted upward to a position (open position) shown in FIG. 6, by the pressure generated by the compression spring 14 placed between the first and second arms 3 and 4 of the supporting member 13. As the original reading device 12 is lifted by the pressure generated by the compression spring 14, the first and second arms 3 and 4 move relative to each other as if the second arm 4 slides out of the first arm 3. Thus, the supporting member 13 increases in length. During the occurrence of this action of the supporting member 13, the toothed inward side (rack 10) of the lateral wall 4*a* of the second arm 4 moves relative to the pinion gear 9 of the first arm 3 while remaining in mesh with the pinion gear 9.

The original reading device 12 (which can be pivotally opened or shut) relative to main assembly of the image forming apparatus 100. As it is pivotally tilted upward, this movement of the original reading device 12 causes the first and second arms 3 and 4 to slide relative to each other, which in turn causes the toothed portion (rack 10) of the second arm 4 to mesh with the pinion gear 9 of the first arm 3, causing thereby the pinion gear 9 to rotate. Consequently, such braking (damping) force that works in the direction to dampen the rotation of the pinion gear 9 is generated by the viscosity-based rotary damper 7.

The opposite end of the lateral wall 4*b*, that is, the other lateral wall, of the second arm 4, from the shaft 6, is provided with a pawl 4*b*1, which protrudes outward of the second arm 4 in terms of the widthwise direction of the second arm 4, whereas the opposite end of the lateral wall 3*a*, that is, the other lateral wall, of the first arm 3, is provided with an unshowen latching portion, which protrudes inward in terms of the widthwise direction of the first arm 3. Thus, as the original reading device 12 is tilted upward to a preset angle relative to the main assembly of the image forming apparatus 100 as shown in FIG. 6, the pawl 4*b*1 of the second arm 4 is latched by the unshown latching portion of the first arm 3. Thus, the supporting member 13 is prevented from being extended further by the compression spring 14, and the original reading device 12 is held in the preset position by the supporting member 13.

In this embodiment, the compression spring 14, first arm 3, second arm 4, first shaft 5, and second shaft 6 are electrically conductive, and are directly or indirectly in contact with each other so that electricity can flow through them. The first shaft 5 is grounded to the main assembly of the image forming apparatus 100 by being connected to the metal plate frame of the main assembly of the image forming apparatus 100, which is electrically conductive.

As for the second shaft 6, it is in connection to an unshown grounding plate (grounding means) attached to the original reading device 12 (which can be pivotally lifted), being thereby grounded. The grounding plate (grounding means) protects the electrical components of the original reading device 12 from static electricity. Further, the electrically conductive compression spring 14 (pressure generating second member) is electrically in connection to the first and second arms 3 and 4, and the first and second arms 3 and 4 are electrically in connection to the first and second shafts 5 and 6, respectively.

Therefore, a grounding path is formed by the compression spring 14 (pressure generating second means) between the original reading device 12 (member which can be upwardly tilted away, or put down). Thus, the grounding plate (grounding means), which is an electrical component of the original reading device 12 is grounded to the main assembly of the image forming apparatus 100 through the compression spring 14 (pressure generating second means). Therefore, various electrical components of the original reading device 12 are protected from static electricity.

In the case of the supporting member 13 in this embodiment, the pressure generated by the resiliency of the compression spring 14 placed between the first and second arms 3 and 4 of the supporting member 13, which are movable relative to each other, works in the direction to cause the original reading device 12 to upwardly tilt away from the image forming apparatus 100. As the original reading device 12 is upwardly tilted away from the image forming apparatus 100, the second arm 4 moves, with its toothed portion (rack 10) remaining meshed with the pinion gear 9 of the first arm 3. Thus, the rotation of the pinion gear 9 is dampened by the viscosity-based rotary damper 7. Therefore, the original reading device 12 is prevented from abruptly tilting upward by the pressure generated by the compression spring 14; it slowly and steadily opens, providing the image forming apparatus 100 with an atmosphere of a high-class machine.

Further, the supporting member 13 has the first arm 3, second arm 4, first shaft 5, second shaft 6, viscosity-based rotary damper 7, pinion gear 9, and toothed portion 10 (rack). Further, the supporting member 13 made of these portions, and the compression spring 14 (pressure generating second means) are integrated as a supporting unit, making it unnecessary for these functional portions of the supporting member 13 to be removed one by one when the original reading device 12 needs to be serviced or overhauled. That is, the employment of the supporting member 13 in this embodiment makes it easier to assemble or disassembly the image forming apparatus 100. Otherwise, the image forming apparatus 100 in this embodiment is the same in structure and effect as the image forming apparatuses in the preceding embodiments.

By the way, in each of the preceding embodiments, the image forming apparatus 100 was structured so that the jam access door 1, which is such a member that can be opened or closed, is upwardly or downwardly pivoted about a horizontal shaft such as the shaft 16 shown in FIGS. 1 and 2, and the horizontal shaft 18 shown in FIG. 6. However, these embodiments are not intended to limit the direction in which the jam access door 1 or original reading device 12 is to be pivotally rotated to be opened or closed, or the angle at which they are tilted. That is, the present invention is also applicable to an image forming apparatus which is different from the image forming apparatus 100 in any of the preceding embodiment, in the orientation of the shaft 16 or 18, and/or the angle at which the jam access door 1 or original reading device 12 is pivotally rotated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-079419 filed on Apr. 12, 2016, which is hereby incorporated by reference herein in its entirety.

What is claimed is:

1. An image forming apparatus comprising:

an openable member rotatable relative to a main assembly of the image forming apparatus; and a supporting member connected between said main assembly of the image forming apparatus and said openable member and configured to support said openable member when said openable member is opened, wherein said supporting member includes a first arm member and a second arm member which are slidable relative to each other, a pinion provided on said first arm member, a viscous damper mounted on a rotation shaft of said pinion, a rack provided on said second arm member and engaged with said pinion, and wherein by opening said openable member, relative slide movement is caused between said first arm member and said second arm member so that said pinion engaged with said rack rotates and a braking force is produced by said viscous damper.

2. An apparatus according to claim 1, wherein said viscous damper is of a rotary type.

3. An apparatus according to claim 1, wherein said openable member is supported so as to be rotatable about a horizontal shaft.

4. An apparatus according to claim 1, further comprising a first urging member applying a tension force between said first arm member and said second arm member, wherein the tension force is applied in a direction of closing said openable member when said openable member is opened.

5. An apparatus according to claim 1, further comprising a second urging member for applying an expansion force between said first arm member and said second arm member, wherein the expansion force is applied in a direction of opening said openable member when said openable member is opened.

6. An apparatus according to claim 1, wherein said viscous damper is a one-way damper which applies the braking force against rotation of said pinion when said openable member is opened and which does not apply the braking force against the rotating operation of said pinion when said openable member is closed.

7. An apparatus according to claim 4, wherein said supporting member and said first urging member unitized.

8. An apparatus according to claim 5, wherein said supporting member and said second urging member are unitized.

9. An apparatus according to claim 1, wherein said rack and said pinion are engaged with each other only in a part of a relative slide movement range between said first arm member and said second arm member.

10. An apparatus according to claim 4, wherein said openable member is provided with an electrical part and ground means protecting said electrical part from static electricity, wherein said ground means is electrically grounded through said first urging member to said main assembly of the image forming apparatus.

11. An apparatus according to claim 5, wherein said openable member is provided with an electrical part and ground means protecting said electrical part from static electricity, wherein said ground means is electrically grounded through said second urging member to said main assembly of the image forming apparatus.

12. An apparatus according to claim 4, wherein said first urging member includes a tension coil spring.

13. An apparatus according to claim 5, wherein said second urging member includes a compression coil spring.

14. An apparatus according to claim 1, wherein said openable member is a jam clearance door configured to open a feeding path for a recording material.

15. An apparatus according to claim 1, wherein said openable member is an original reading apparatus.

* * * * *